US006715545B2

(12) United States Patent
McGregor et al.

(10) Patent No.: US 6,715,545 B2
(45) Date of Patent: Apr. 6, 2004

(54) TRANSITION MEMBER FOR MAINTAINING FOR FLUID SLURRY VELOCITY THERETHROUGH AND METHOD FOR USE OF SAME

(75) Inventors: Ronald W. McGregor, Carrollton, TX (US); David A. Heji, Dallas, TX (US); Travis T. Hailey, Jr., Sugar Land, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 49 days.

(21) Appl. No.: 10/107,507

(22) Filed: Mar. 27, 2002

(65) Prior Publication Data

US 2003/0183386 A1 Oct. 2, 2003

(51) Int. Cl.[7] ..... E21B 43/04
(52) U.S. Cl. ..... 166/235; 166/278; 166/51
(58) Field of Search ..... 166/278, 51, 236, 166/235

(56) References Cited

U.S. PATENT DOCUMENTS

| | | | | |
|---|---|---|---|---|
| 2,342,913 A | | 2/1944 | Williams et al. | |
| 2,344,909 A | | 3/1944 | Williams et al. | |
| 4,510,996 A | * | 4/1985 | Hardin | 166/227 |
| 4,945,991 A | | 8/1990 | Jones | 166/278 |
| 5,082,052 A | | 1/1992 | Jones et al. | 166/51 |

(List continued on next page.)

FOREIGN PATENT DOCUMENTS

| | | | |
|---|---|---|---|
| EP | 1 132 571 | 9/2001 | E21B/43/267 |
| WO | WO 99/12630 | 3/1999 | B01D/29/15 |
| WO | WO 00/61913 | 10/2000 | E21B/43/04 |
| WO | WO 01/14691 | 3/2001 | E21B/43/08 |
| WO | WO 01/44619 | 6/2001 | E21B/43/04 |
| WO | WO 02/10554 | 2/2002 | E21B/43/26 |

OTHER PUBLICATIONS

"Mechanical Fluid–Loss Control Systems Used During Sand Control Operations," H. L. Restarick of Otis Engineering Corp., 1992.
"Sand Control Screens," Halliburton Energy Services, 1994.
"Frac Pack Technology Still Evolving," Charles D. Ebinger of Ely & Associates Inc.; Oil & Gas Journal, Oct. 23, 1995.
"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb. 2000.
"CAPS$^{sm}$ Concentric Annular Packing Service for Sand Control," Halliburton Energy Services, Inc., Aug. 2000.
"CAPS$^{sm}$ Sand Control Service for Horizontal Completions Improves Gravel Pack Reliability and Increases Production Potential from Horizontal Completions," Halliburton Energy Services, Inc., Aug. 2000.
"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar. 2001.

*Primary Examiner*—David Bagnell
*Assistant Examiner*—Daniel P. Stephenson
(74) *Attorney, Agent, or Firm*—Lawrence R. Youst

(57) ABSTRACT

A transition member (130) coupled between first and second slurry delivery devices (132, 134) for maintaining fluid slurry velocity therethrough is disclosed. Each slurry delivery device (132, 134) has a slurry passageway (144, 164) having a cross sectional area. The transition member (130) includes a transition passageway (200) operable to provide fluid communication between the slurry passageways (144, 164) of the slurry delivery devices (132, 134). The cross sectional area of at least a portion of the transition passageway (200) approximates the cross sectional area of the slurry passageways (144, 164) of the slurry delivery devices (132, 134). This allows the transition member (130) to maintain the fluid slurry velocity above the settling velocity of the slurry.

36 Claims, 9 Drawing Sheets

U.S. PATENT DOCUMENTS

| | | | | |
|---|---|---|---|---|
| 5,113,935 | A | 5/1992 | Jones et al. | 166/51 |
| 5,161,613 | A | 11/1992 | Jones | 166/242 |
| 5,161,618 | A | 11/1992 | Jones et al. | 166/308 |
| 5,333,688 | A | 8/1994 | Jones et al. | 166/278 |
| 5,355,956 | A | 10/1994 | Restarick | 166/296 |
| 5,390,966 | A | 2/1995 | Cox et al. | 285/137.1 |
| 5,419,394 | A | 5/1995 | Jones | 166/51 |
| 5,443,117 | A | 8/1995 | Ross | 166/51 |
| 5,476,143 | A | 12/1995 | Sparlin et al. | 166/233 |
| 5,515,915 | A | 5/1996 | Jones et al. | 166/51 |
| 5,588,487 | A | 12/1996 | Bryant | 166/51 |
| 5,636,691 | A | 6/1997 | Hendrickson et al. | 166/278 |
| 5,755,286 | A | 5/1998 | Ebinger | 166/281 |
| 5,842,516 | A | 12/1998 | Jones | 166/56 |
| 5,848,645 | A | 12/1998 | Jones | 166/280 |
| 5,868,200 | A | 2/1999 | Bryant et al. | 166/51 |
| 5,890,533 | A | 4/1999 | Jones | 166/51 |
| 5,921,318 | A | 7/1999 | Ross | 166/250.17 |
| 5,934,376 | A | 8/1999 | Nguyen et al. | 166/278 |
| 6,003,600 | A | 12/1999 | Nguyen et al. | 166/281 |
| 6,047,773 | A | 4/2000 | Zeltmann et al. | 166/281 |
| 6,059,032 | A | 5/2000 | Jones | 166/278 |
| 6,116,343 | A | 9/2000 | Van Petegem et al. | 166/297 |
| 6,125,933 | A | 10/2000 | Ross | 166/250.01 |
| 6,220,345 | B1 | 4/2001 | Jones et al. | 166/51 |
| 6,227,303 | B1 | 5/2001 | Jones | 166/378 |
| 6,230,803 | B1 | 5/2001 | Morton et al. | 166/278 |
| 6,343,651 | B1 | 2/2002 | Bixenman | 166/278 |
| 6,405,800 | B1 * | 6/2002 | Walker et al. | 166/278 |

* cited by examiner

TRANSITION MEMBER FOR MAINTAINING FOR FLUID SLURRY VELOCITY THERETHROUGH AND METHOD FOR USE OF SAME

TECHNICAL FIELD OF THE INVENTION

This invention relates in general to preventing the production of particulate materials through a wellbore traversing an unconsolidated or loosely consolidated subterranean formation and, in particular to, a transition member for a gravel packing apparatus that maintains fluid slurry velocity therethrough.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulates. For example, the particulates cause abrasive wear to components within the well, such as tubing, pumps and valves. In addition, the particulates may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a workstring to a position proximate the desired production interval. A fluid slurry including a liquid carrier and a particulate material known as gravel is then pumped down the workstring and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulates carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Prior art devices and methods have been developed which attempt to overcome this sand bridge problem. For example, attempts have been made to use devices having perforated shunt tubes or bypass conduits that extend along the length of the sand control screen to provide an alternate path for the fluid slurry around the sand bridge. It has been found, however, that shunt tubes installed on the exterior of sand control screens are susceptible to damage during installation. In addition, it has been found, that it is difficult and time consuming to make all of the necessary transition sections between the numerous joints of shunt tubes required for typical production intervals. Moreover, it has been found that the velocity of the fluid slurry may decrease below the settling velocity of the fluid slurry in these transition sections such that the gravel drops out of the fluid slurry and clogs the transition section preventing further flow therethrough.

Therefore a need has arisen for an apparatus and method for gravel packing a production interval traversed by a wellbore that overcomes the problems created by sand bridges. A need has also arisen for such an apparatus that is not susceptible to damage during installation. Further, a need has arisen for such an apparatus that is not difficult or time consuming to assemble. Moreover, a need has arisen for such an apparatus that maintains sufficient velocity of the fluid slurry in transition sections.

SUMMARY OF THE INVENTION

The present invention disclosed herein comprises an apparatus and method for gravel packing a production interval traversed by a wellbore that overcomes the problems created by sand bridges. The apparatus and method of the present invention not only allow for the delivery of the gravel packing fluid slurry but also maintain sufficient velocity of the fluid slurry in transition members that couple together two slurry delivery devices, such as gravel packing apparatuses.

Each of the transition members comprises a first end that is coupled to one slurry delivery device and a second end that is coupled to another slurry delivery device. Each of the slurry delivery devices has a slurry passageway with a cross sectional area that determines the volumetric capacity of slurry that may be pumped therethrough. The transition member includes a transition passageway that provides fluid communication between the slurry passageways of the two slurry delivery devices coupled to the transition member.

In one embodiment of the transition members, at least a portion of the transition passageway has a cross sectional area that approximates the cross sectional area of the slurry passageways of the slurry delivery devices. This matching of areas maintains the fluid slurry velocity when the fluid slurry travels through the transition member. In this embodiment, the transition passageway may comprise an annular area that may have an annular throat, wherein the annular throat has a cross sectional area that approximates the cross sectional area of the slurry passageways. Alternatively, the transition passageway may comprise a plurality of longitudinal fluid passageways or a spiral passageway.

In another embodiment of the transition members, the transition passageway may comprise inner and outer surfaces that define an annular passageway therebetween wherein at least one of the inner and outer surfaces is contoured such that the distance between the inner and outer surfaces varies along the length of the annular passageway, thereby maintaining fluid slurry velocity when the fluid slurry travels through the transition member. Whether the contoured surface is the inner surface, the outer surface or both the inner and the outer surfaces are contoured, the contoured surface may be an arc like surface, a pyramid shaped surface, a pyramid shaped surface with a plateau or other suitably shaped surface that maintains the fluid slurry velocity when the fluid slurry travels through the transition member. Regardless of the shaped of the contoured surface, the annular passageway may comprise an annular throat, wherein the annular throat has a cross sectional area that approximates the cross sectional area of the slurry passageways of the slurry delivery devices.

In another aspect, the present invention is directed to a method for maintaining fluid slurry velocity in a transition member between two slurry delivery devices, such as gravel packing apparatuses. The method comprises the steps of coupling a transition member between the two slurry delivery devices which establishes fluid communication from a slurry passageway of one slurry delivery device to a slurry passageway of the other slurry delivery device through a transition passageway of the transition member. Additionally, the method includes disposing the transition member and the slurry delivery devices downhole, pumping a fluid slurry into the slurry passageway of one of the slurry delivery devices, through the transition passageway of the transition member and into the slurry passageway of the other the slurry delivery devices, and maintaining the fluid slurry velocity in the transition member. This is achieved, for example, by making the cross sectional area of at least a portion of the transition passageway approximately the same as the cross sectional area of the slurry passageways, contouring at least one of the inner and outer surfaces of an annular passageway such that the distance between the inner and outer surfaces varies along the length of the annular passageway or both.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
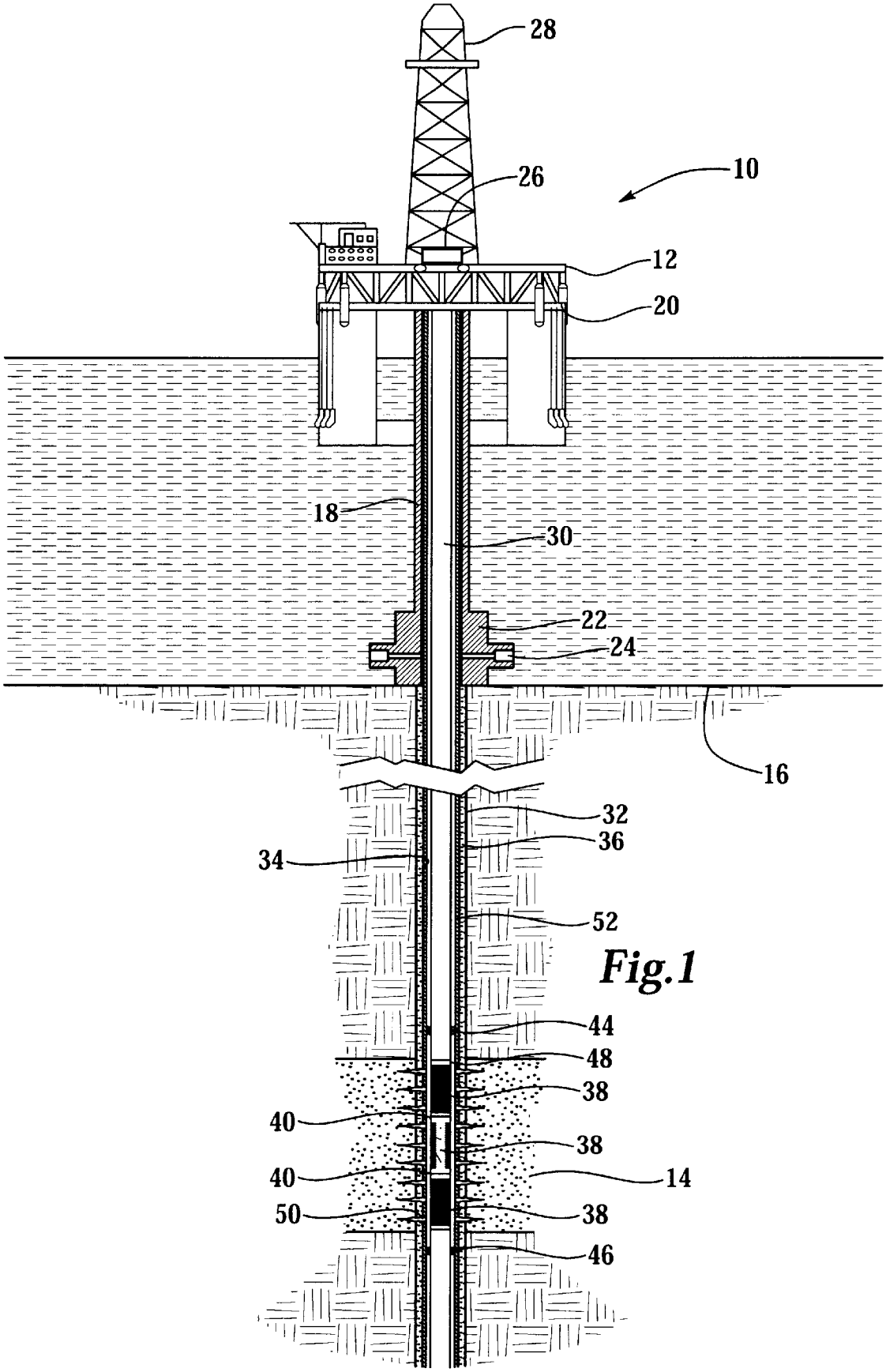
FIG. 1 is a schematic illustration of an offshore oil and gas platform operating an apparatus for gravel packing an interval of a wellbore of the present invention.

Referring initially to FIG. 1, several apparatuses for gravel packing an interval of a wellbore operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools such as a plurality of apparatuses 38 that are coupled together with transition members 40. These apparatuses 38 are used for gravel packing an interval of wellbore 32 adjacent to formation 14 between packers 44, 46 and into annular region 48. When it is desired to gravel pack annular region 48, work string 30 is lowered through casing 34 until apparatuses 38 are positioned adjacent to formation 14 including perforations 50. Thereafter, a fluid slurry including a liquid carrier and a particulate material such as sand, gravel or proppants is pumped down work string 30.

The fluid slurry may be injected entirely into the first apparatus 38 and sequentially flow through subsequent apparatuses 38, passing through transition members 40, as described in more detail below, between each apparatus 38. During this process, portions of the fluid slurry exit each apparatus 38 such that the fluid slurry enters annular region 48. Once in annular region 48, a portion the gravel in the fluid slurry is deposited therein. Some of the liquid carrier may enter formation 14 through perforation 50 while the remainder of the fluid carrier, along with some of the gravel, reenters certain sections of apparatuses 38 depositing gravel in those sections. As a sand control screen (not pictured) is positioned within each of the apparatuses 38, the gravel remaining in the fluid slurry is disallowed from further migration. The liquid carrier, however, can travel through the sand control screens, into work string 30 and up to the surface in a known manner, such as through a wash pipe and into the annulus 52 above packer 44. The fluid slurry is pumped down work string 30 through apparatuses 38 until annular section 48 surrounding apparatuses 38 and portions of apparatuses 38 are filled with gravel.

Alternatively, instead of injecting the entire stream of fluid slurry into apparatuses 38 a portion of the fluid slurry could be injected directly into annular region 48 in a known manner such as through a crossover tool (not pictured) which allows the slurry to travel from the interior of work string 30 to the exterior of work string 30. Again, once this portion of the fluid slurry is in annular region 48, a portion of the gravel in the fluid slurry is deposited in annular region 48. Some of the liquid carrier may enter formation 14 through perforation 50 while the remainder of the fluid carrier along with some of the gravel enters certain sections of apparatuses 38 filling those sections with gravel. The sand control screens (not pictured) within apparatuses 38 disallow further migration of the gravel but allows the liquid carrier to travel therethrough into work string 30 and up to the surface. If the fluid slurry is partially injected directly into annular region 48 and a sand bridge forms, the portion of the fluid slurry that is injected into apparatuses 38 will bypass this sand bridge such that a complete pack can nonetheless be achieved. The portion of the fluid slurry entering apparatuses 38 may enter apparatuses 38 directly from work string 30 or may enter apparatuses 38 from annular region 48 via one or more inlets on the exterior of one or more of the apparatuses 38. These inlets may include pressure actuated devices, such as valves, rupture disks and the like disposed therein to regulate the flow of the fluid slurry therethrough.

Even though FIG. 1 depicts a vertical well, it should be noted by one skilled in the art that the apparatuses and transition members for gravel packing an interval of a wellbore of the present invention are equally well-suited for use in deviated wells, inclined wells or horizontal wells. Also, even though FIG. 1 depicts an offshore operation, it should be noted by one skilled in the art that the apparatuses and transition members for gravel packing an interval of a wellbore of the present invention are equally well-suited for use in onshore operations.

Figure 2:
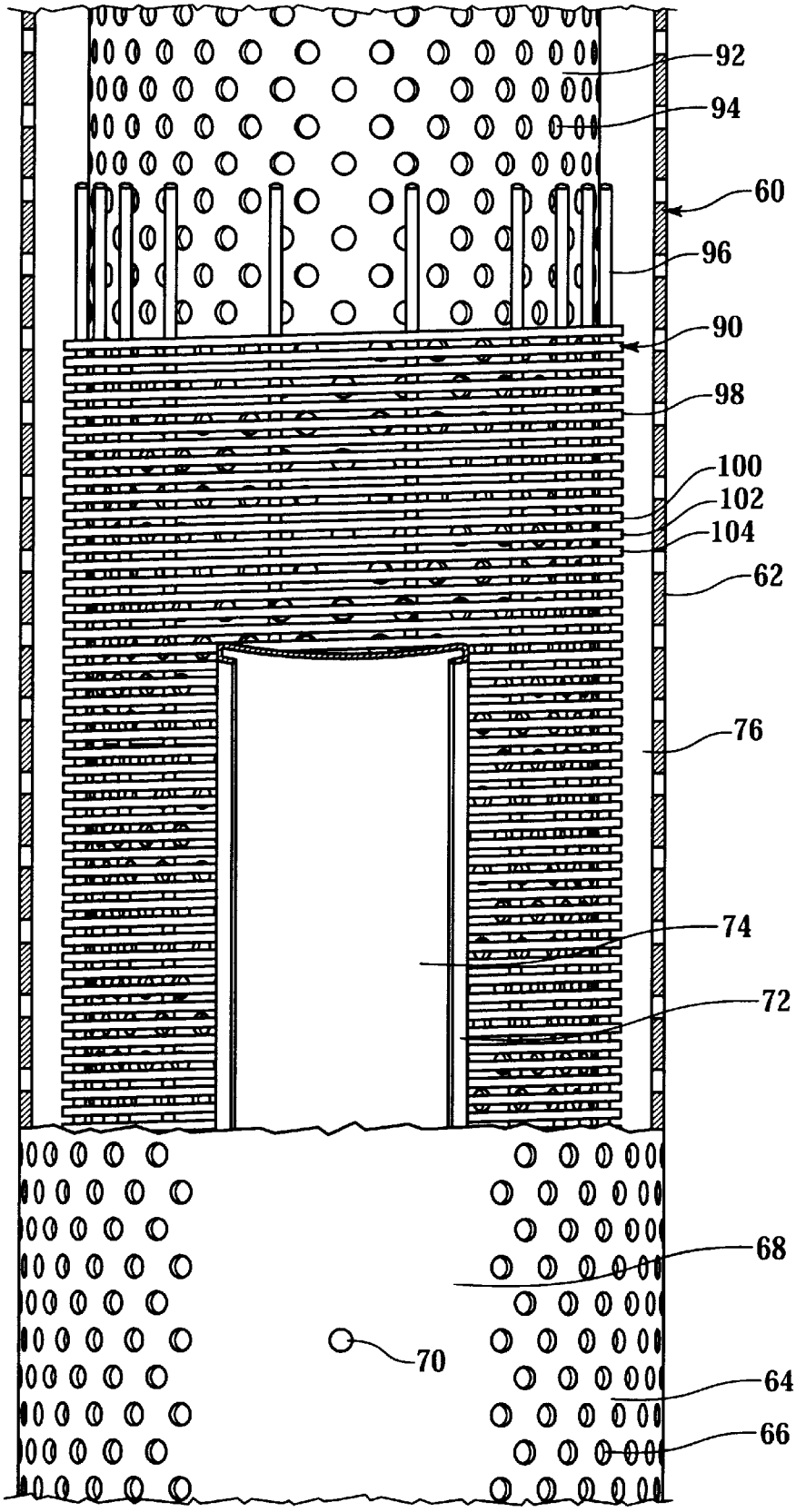
FIG. 2 is partial cut away view of an apparatus for gravel packing an interval of a wellbore of the present invention in position around a sand control screen.

Referring now to FIG. 2, therein is depicted a partial cut away view of an apparatus for gravel packing an interval of a wellbore of the present invention that is generally designated 60. Apparatus 60 has an outer tubular 62. A portion of the side wall of outer tubular 62 is an axially extending production section 64 that includes a plurality of openings 66. Another portion of the side wall of outer tubular 62 is an axially extending nonproduction section 68 that includes outlets 70, only one of which is shown. For reasons that will become apparent to those skilled in the art, the density of opening 66 within production section 64 of outer tubular 62 is much greater than the density of outlets 70 in nonproduction section 68 of outer tubular 62. Also, it should be noted by those skilled in the art that even though FIG. 2 has depicted openings 66 and outlets 70 as being circular, other shaped openings may alternatively be used without departing from the principles of the present invention. Likewise, even though FIG. 2 has depicted openings 66 as being the same size as outlets 70, openings 66 could alternatively be larger or smaller than outlets 70 without departing from the principles of the present invention. In addition, the exact number, size and shape of openings 66 are not critical to the present invention, so long as sufficient area is provided for fluid production therethrough and the integrity of outer tubular 62 is maintained.

Disposed within outer tubular 62 and on opposite sides of each other is a pair of channels 72, only one channel 72 being visible. Channels 72 provide substantial circumferential fluid isolation between production section 64 and nonproduction section 68 of outer tubular 62. As such, channels 72 define the circumferential boundary between a slurry passageway 74, having an outer radial boundary defined by nonproduction section 68 of outer tubular 62 and a production pathway 76, having an outer radial boundary defined by production section 64 of outer tubular 62. It should be noted by those skilled in the art that even though FIG. 2 depicts channels 72 as being open on the side facing outer shroud 62, channels 72 could alternatively be closed on all sides, thereby providing complete isolation for slurry passageway 74 without the need for a surface of outer shroud 62.

Disposed within channels 72 is a wire wrap screen assembly 90. Screen assembly 90 has a base pipe 92 that has a plurality of openings 94. A plurality of ribs 96 are spaced around base pipe 92. Ribs 96 are generally symmetrically distributed about the axis of base pipe 92. Ribs 96 are depicted as having a cylindrical cross section, however, it should be understood by one skilled in the art that ribs 96 may alternatively have a rectangular or triangular cross section or other suitable geometry. Additionally, it should be understood by one skilled in the art that the exact number of ribs 96 will be dependent upon the diameter of base pipe 92 as well as other design characteristics that are well known in the art.

Wrapped around ribs 96 is a screen wire 98. Screen wire 98 forms a plurality of turns, such as turn 100, turn 102 and turn 104. Between each of the turns is a gap through which formation fluids flow. The number of turns and the gap between the turns are determined based upon the characteristics of the formation from which fluid is being produced and the size of the gravel to be used during the gravel packing operation. Together, ribs 96 and screen wire 98 may form a sand control screen jacket which is attached to base pipe 92 by welding or other suitable technique. It should be understood by those skilled in the art that while ribs 98 and the sand control screen jacket are depicted in FIG. 2, a wire mesh may alternatively be used in place of either or both to form the barrier to sand production or screen wire 100 may be wrapped directly around base pipe 94.

It should be apparent to those skilled in the art that other embodiments of apparatuses for gravel packing an interval of a wellbore of the present invention are possible. For example, the apparatus for gravel packing an interval of a wellbore of the present invention may comprise an outer tubular wherein a portion of the side wall of the outer tubular is an axially extending production section that includes a plurality of openings. Another portion of the side wall of the outer tubular is an axially extending nonproduction section that includes one or more outlets. Disposed within the outer tubular is an inner tubular. A portion of the side wall of the inner tubular is an axially extending production section that is substantially circumferentially aligned with the production section of the outer tubular. The production section of the inner tubular has a plurality of openings therethrough. Another portion of the side wall of the inner tubular is an axially extending nonproduction section that is substantially circumferentially aligned with the nonproduction section of the outer tubular. The nonproduction section of the inner tubular has no openings therethrough.

Disposed within an annulus between the outer tubular and the inner tubular is a channel. The channel includes a web and a pair of oppositely disposed sides having ends that are attached to the inner tubular by, for example, welding or other suitable techniques. The channel includes one or more outlets that are substantially aligned with the outlets of the outer tubular. Together, the channel and the nonproduction section of the inner tubular define a slurry passageway. A production pathway is also defined having radial boundaries of the production section of the outer tubular and the production section of the inner tubular. The slurry passageway and the production pathway are in fluid isolation from one another.

The apparatus may alternatively comprise a sand control screen that is positioned within the wellbore and a tube and manifold system that is positioned between the sand control screen and the wellbore. The tube and manifold system may be constructed in sections that are integral with each section of the sand control screen such that sections of the apparatus are simply threaded together in a known manner prior to running it downhole. Alternatively, the tube and manifold system may be run downhole and positioned proximate the formation prior to running the sand control screen downhole. In this case, when the sand control screen is run downhole, it is positioned within the tube and manifold system.

In either case, the tube and manifold system is used to selectively deliver the fluid slurry to a plurality of levels within the interval when the apparatus is in the operable position. The tube and manifold system comprises, in series, one or more tubes then a manifold, which serves as the transition member, followed by one or more tubes then another manifold and so forth. The tubes of the tube and manifold system have first and second ends which are open but do not have openings in their side walls as the fluid slurry is discharged from the tube and manifold system only through exit ports in the manifolds.

Alternatively, a screen assembly itself may include one or more slurry passageways each of which are defined by a nonperforated section of the base pipe, the two ribs positioned within that nonperforated section of the base pipe and a portion of the wire that includes a filler material in the gaps that are circumferentially aligned with that nonperforated section of the base pipe. The slurry passageways are used to carry the fluid slurry containing gravel past any sand bridges that may form in the annulus surrounding the screen assembly. The fluid slurry is discharged from the screen assembly via a plurality of manifolds that are in fluid communication with the slurry passageways. The manifolds serve as the transition members and selectively discharge the fluid slurry to a plurality of levels of the interval through exit ports formed therein when the screen assembly is in an operable position. The exit ports may be either circumferentially aligned with the slurry passageways, circumferentially misaligned with the slurry passageways or both. The fluid communication between the manifolds and the slurry passageways may be established using tubes that extend from the manifolds into each adjacent sections of the slurry passageways.

The previous apparatus embodiments are offered by way of example, and not by way of limitation. It should be apparent to one skilled in the art that a wide variety of apparatuses for gravel packing an interval are possible and considered within the scope of the present invention.

Figure 3:
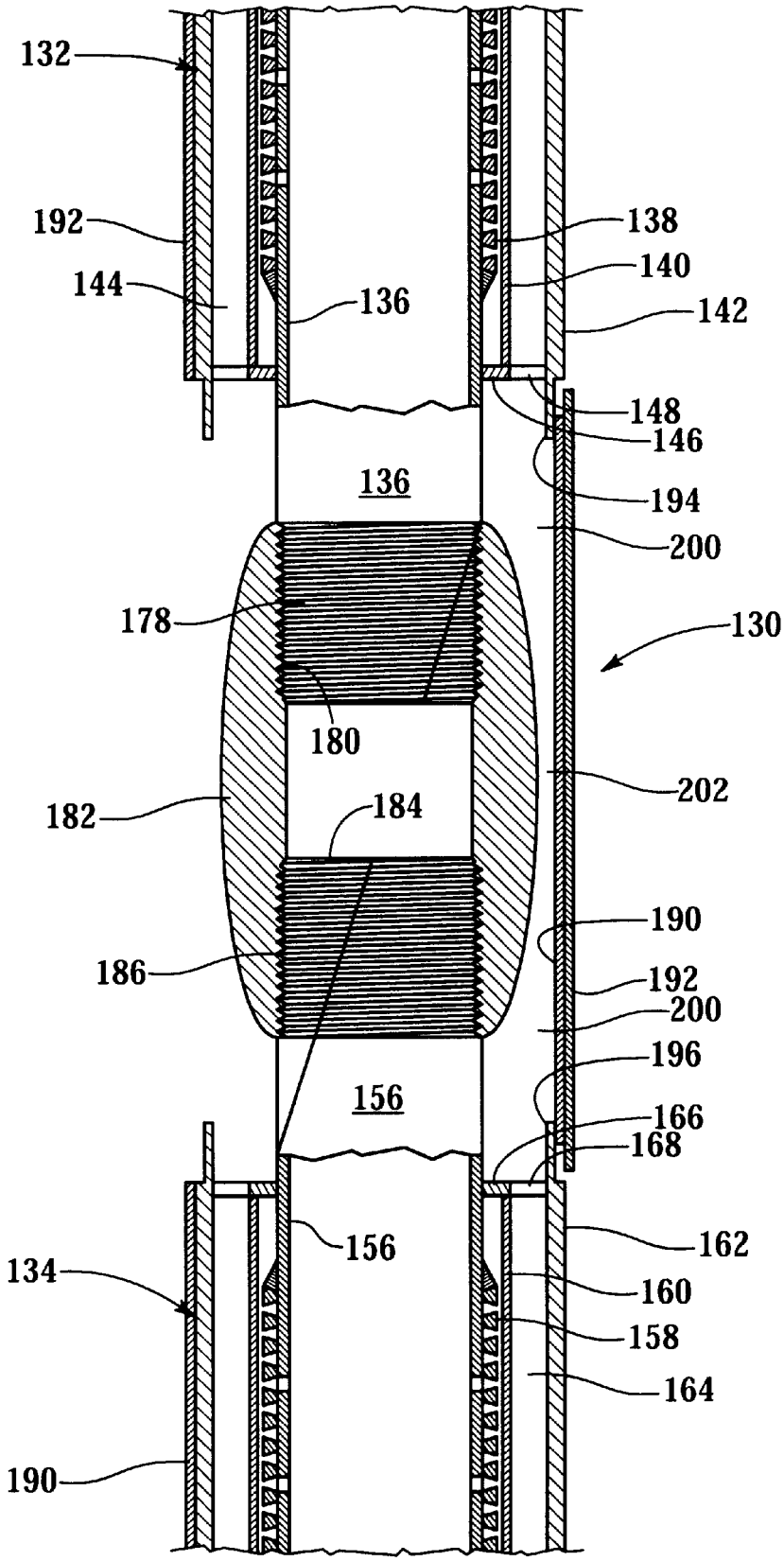
FIG. 3 is a half-sectional view of two sections of an apparatus for gravel packing an interval of a wellbore that are coupled together by a transition member of the present invention.

Referring now to FIG. 3, a transition member of the present invention which is particularly useful in gravel-packing long intervals of vertical, inclined and/or horizontal wells is illustrated and generally designated 130. Transition member 130 is illustrated in a half-sectional view with one side showing transition member 130 before assembly and the other side showing transition member 130 after assembly is completed in accordance with the present invention. Transition member 130 forms a passageway for fluid flow between adjacent gravel packing apparatuses 132, 134 upon coupling apparatuses 132, 134 together. Apparatus 132 includes a base pipe 136 having a sand control screen 138 positioned therearound. Channels 140 are coupled to an outer shroud 142 and form slurry passageways 144. Additionally, outer shroud 142 provides protection to apparatus 132 and in particular to sand control screen 138 during installation. A baseplate 146 is attached between base pipe 136 and outer shroud 142. Baseplate 146 has openings 148 that are aligned with slurry passageways 144 such that the fluid slurry traveling through slurry passageway 144 may pass therethrough.

Similarly, apparatus 134 includes base pipe 156 having a sand control screen 158 positioned therearound. Channels 160 are coupled to an outer shroud 162 forming slurry passageways 164 therebetween. A baseplate 166 is attached between base pipe 156 and outer shroud 162. Baseplate 166 has openings 168 that are aligned with slurry passageway 164 such that the fluid slurry traveling through slurry passageways 164 may pass therethrough.

Base pipe 136 includes outer threads 178 that mate with inner threads 180 of coupling 182 of transition member 130 which is also joined to base pipe 156 via outer threads 184 and inner threads 186. Preferably, coupling 182 is coupled to base pipe 156 during fabrication while base pipe 136 is coupled to coupling 182 at the rig floor. Initially, a single slot sleeve 190 of transition member 130 is positioned against outer shroud 162 of apparatus 134 and an alternating slot sleeve 192 of transition member 130 is positioned against outer shroud 142 of apparatus 132 as depicted on the left side of FIG. 3. Single slot sleeve 190 and alternating slot sleeve 192 are then simultaneously slid toward one another positioning single slot sleeve 190 under alternating slot sleeve 192. Single slot sleeve 190 and alternating slot sleeve 192 are both inwardly radially biased. Therefore, once single slot sleeve 190 and alternating slot sleeve 192 are positioned about coupling 182 as depicted on the right of FIG. 3, alternating slot sleeve 192 rests against a lip 194 of outer shroud 142 and a lip 196 of outer shroud 162.

In accordance with the present invention, transition member 130 provides an annular area 200 formed between coupling 182 and sleeves 190, 192. In the illustrated embodiment, the outer surface of coupling 102 is contoured into an arc like shape that creates an annular throat 202 which assures that the velocity of the fluid slurry traveling through transition member 130 is maintained above the settling velocity of the fluid slurry. Preferably, the cross sectional area of annular throat 202 is approximately equal to the sum of the cross sectional areas of the slurry passageways associated with each apparatus 132, 134. For example, the cross sectional area of annular throat 202 may approximate the sum of the cross sectional areas of slurry passageways 144 of apparatus 132. Preferably, the distances between base plates 146, 166 and the respective ends of coupling 182 are minimized to help maintain fluid slurry velocity. The system, however, can tolerate some decrease in fluid slurry velocity and a cross sectional area larger or smaller than the cross sectional area of the slurry passageways is acceptable at annular throat 202.

Sealing means such as wielding, o-rings or the like (not shown) may be provided between alternating slot sleeve 192 and apparatuses 132, 134. It should be noted, however, that some leakage is acceptable since the purpose of apparatuses 132, 134 is to provide a uniform gravel pack along the entire length of the production interval. For example, minimum leakage between the alternating slot 190 and lips 194, 196 is acceptable. It should be noted by one skilled in the art that although apparatuses 132, 134 are illustrated as having two channels, other numbers of channels, either more than two or less than two channels may be implemented by the present invention.

Figure 4:
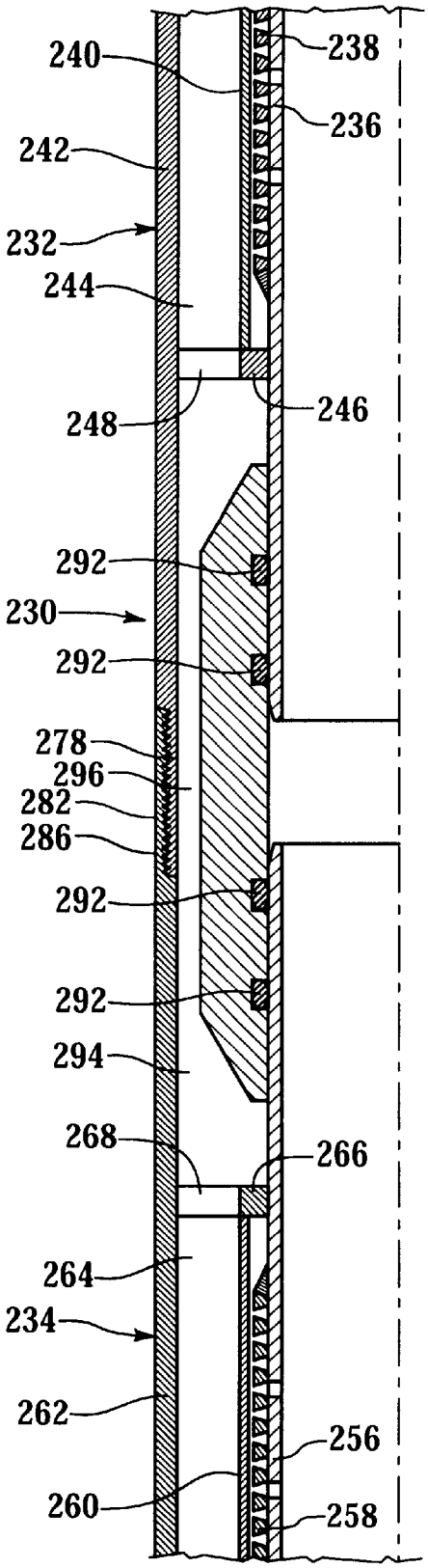
FIG. 4 is a quarter-sectional view of two sections of an apparatus for gravel packing an interval of a wellbore that are coupled together by a transition member of the present invention.

Referring now to FIG. 4, a transition member of the present invention is illustrated and generally designated 230. Transition member 230 is illustrated in a quarter-sectional view showing transition member 230 after assembly is completed in accordance with the present invention. Transition member 230 forms a fluid passageway between adjacent gravel packing apparatuses 232, 234 upon coupling apparatuses 232, 234 together. Apparatus 232 includes a base pipe 236 having a sand control screen 238 positioned therearound. Channels 240 are coupled to an outer shroud 242 and form slurry passageways 244. A base plate 246 is attached between base pipe 234 and outer shroud 242. Base plate 246 has openings 248 that are aligned with slurry passageways 244 such that the fluid slurry traveling through slurry passageways 244 may pass therethrough.

Similarly, apparatus 234 includes base pipe 256 having a sand control screen 258 positioned therearound. Channels 260 are coupled to an outer shroud 262 forming slurry passageways 264 therebetween. A base plate 266 is attached between base pipe 256 and outer shroud 262. Baseplate 266 has openings 268 that are aligned with slurry passageways 264 such that the fluid slurry traveling through slurry passageways 264 may pass therethrough.

Outer shroud 242 includes a pin end 278 that threadably mates with a box end 282 of outer shroud 262 to form a threaded flush joint 286. Positioned with joint 286 is a sleeve 290 that couples base pipe 236 to base pipe 256. As the respective end sections of base pipes 236, 256 are slidably and sealably received within sleeve 290, this connection may be achieved at the rig floor. Alternatively, sleeve 290 could be attached to one of the ends of a base pipe during fabrication, in which case a threaded or welded attachment may be preferred for that connection. In the illustrated embodiment, a pair of seals 292 is positioned between sleeve 290 and each of the end sections of base pipes 236, 256. Preferably, seals 292 are O-ring, d-ring or pedestal-type seals. It should be apparent to one skilled in the art, however, that any seal heretofore known or unknown may be implemented.

In accordance with the present invention, transition member 230 provides an annular area 294 formed between outer shrouds 242, 262 and sleeve 290. In the illustrated embodiment, the outer surface of sleeve 290 has a contoured shaped referred to herein as a pyramid with a plateau creating an annular throat 296 which assures that the velocity of the fluid slurry within transition member 230 is maintained above the settling velocity of the fluid slurry. Preferably, the cross sectional area of annular throat 296 is approximately equal to the sum of the cross sectional areas of the slurry passageways associated with each apparatus 232, 234.

Figure 5:
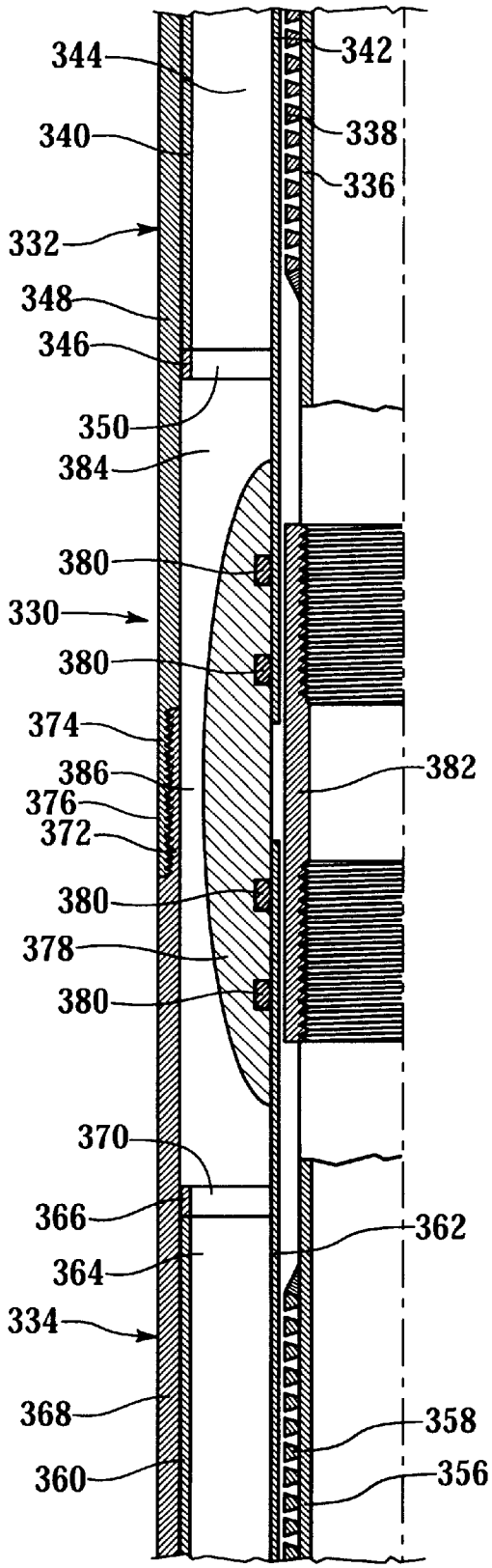
FIG. 5 is a quarter-sectional view of two sections of an apparatus for gravel packing an interval of a wellbore that are coupled together by a transition member of the present invention.

Referring now to FIG. 5, a transition member of the present invention is illustrated and generally designated 330. Transition member 330 is illustrated in a quarter-sectional view showing transition member 330 after assembly is completed in accordance with the present invention. Transition member 330 forms a fluid passageway between adjacent gravel packing apparatuses 332, 334 upon coupling apparatuses 332, 334 together. Apparatus 332 includes a base pipe 336 having a sand control screen 338 positioned therearound. Channels 340 are coupled to an inner shroud 342 and form slurry passageways 344. A base plate 346 is attached between inner shroud 342 and an outer shroud 348. Base plate 346 has openings 350 that are aligned with slurry passageways 344 such that the fluid slurry traveling through slurry passageways 344 may pass therethrough.

Similarly, apparatus 334 includes base pipe 356 having a sand control screen 358 positioned therearound. Channels 360 are coupled to an inner shroud 362 forming slurry passageways 364 therebetween. A base plate 366 is attached between inner shroud 362 and an outer shroud 368. Base plate 366 has openings 370 that are aligned with slurry passageways 364 such that the fluid slurry traveling through slurry passageways 364 may pass therethrough.

Outer shroud 368 includes a pin end 372 that threadably mates with a box end 374 of outer shroud 348 to form a threaded flush joint 376. Positioned with joint 376 is a sleeve 378 that couples inner shroud 342 to inner shroud 362. As the respective end sections of inner shrouds 342, 362 are slidably and sealably received within sleeve 378, this connection may be achieved at the rig floor. Alternatively, sleeve 378 could be attached to one of the ends of an inner shroud during fabrication, in which case a threaded or welded attachment may be preferred for that connection. In the illustrated embodiment a pair of seals 380 is positioned between sleeve 378 and each of the end sections of inner shrouds 342, 362.

In addition, a screen coupling 382 may be used to threadably couple the ends of base pipes 336, 356. Preferably, one such connection is made during fabrication with the other being made on the rig floor. When screen coupling 382 is used, the pitch of the threads of screen coupling 382 must be properly matched to the threads of outer shrouds 348, 362.

In accordance with the present invention, transition member 330 provides an annular area 384 formed between outer shrouds 348, 362 and sleeve 378. Due to the contoured shape of sleeve 378, an annular throat 386 assures that the velocity of the fluid slurry within transition member 330 is maintained above the settling velocity of the fluid slurry. Preferably, the cross sectional area of annular throat 386 is approximately equal to the sum of the cross sectional areas of the slurry passageways associated with each apparatus 332, 334.

Figure 6:
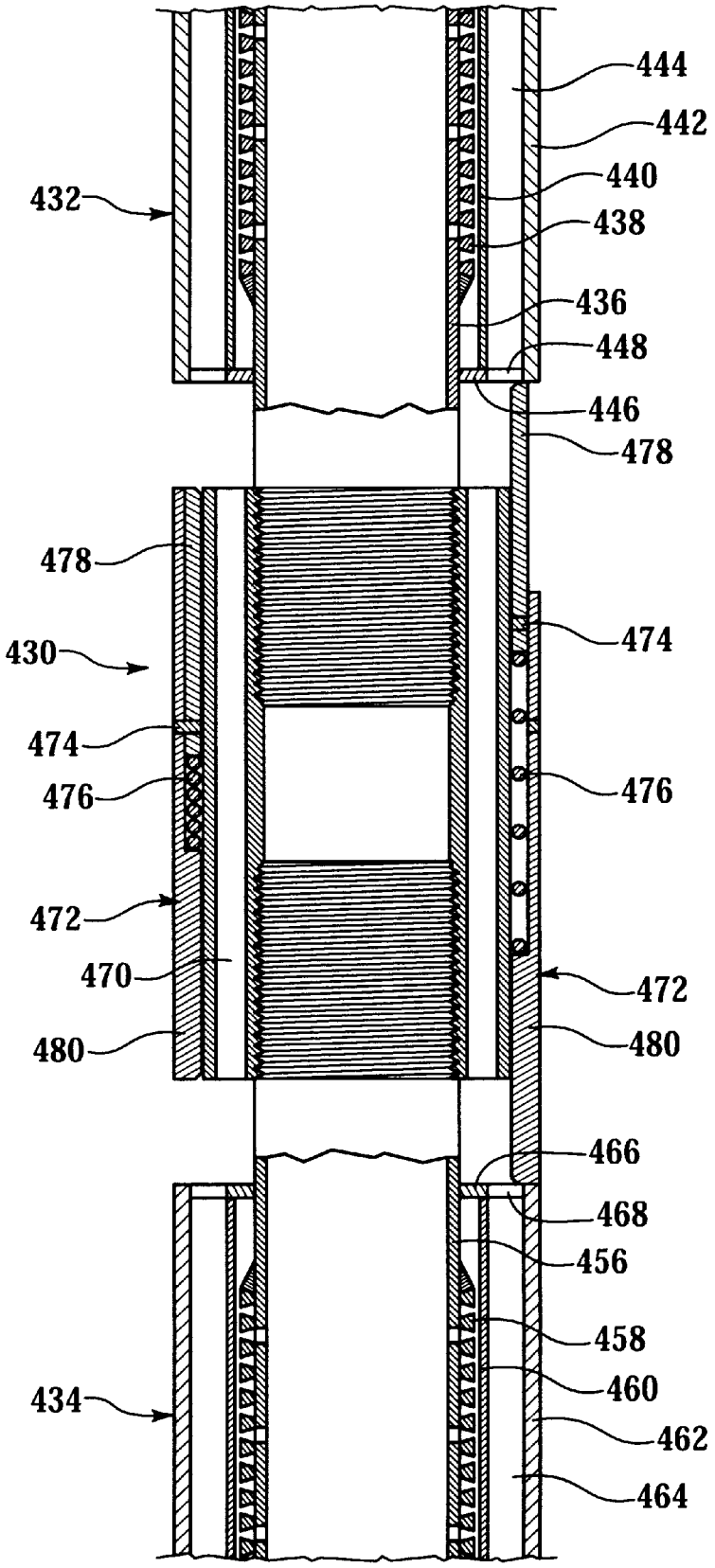
FIG. 6 is a half-sectional view of two sections of an apparatus for gravel packing an interval of a wellbore that are coupled together by a transition member of the present invention.

Referring now to FIG. 6, a transition member of the present invention is illustrated and generally designated 430. Transition member 430 is illustrated in a half-sectional view with one side showing transition member 430 before assembly is complete and the other side showing transition member 430 after assembly is completed in accordance with the present invention. Transition member 430 provides a plurality of fluid passageways between adjacent gravel packing apparatuses 432, 434 upon coupling apparatuses 432, 434 together. Apparatus 432 includes a base pipe 436 having a sand control screen 438 positioned therearound. Channels 440 are coupled to an outer shroud 442 and form slurry passageways 444. A base plate 446 is attached between base pipe 436 and outer shroud 442. Base plate 436 has openings 448 that are aligned with slurry passageways 444 such that the fluid slurry traveling through slurry passageways 444 may pass therethrough.

Similarly, apparatus 434 includes base pipe 456 having a sand control screen 458 positioned therearound. Channels 460 are coupled to an outer shroud 462 forming slurry passageways 464 therebetween. A base plate 466 is attached between base pipe 456 and outer shroud 462. Base plate 466 has openings 468 that are aligned with slurry passageways 464 such that the fluid slurry traveling through slurry passageways 464 may pass therethrough.

Base pipe 436 is threadably coupled to transition member 430 which is also threadably coupled to base pipe 456. Preferably, transition member 430 is coupled to base pipe 456 during fabrication while base pipe 436 is coupled thereto at the rig floor. Transition member 430 has a plurality of slurry passageways 470 for slurry flow therethrough.

Initially, spring loaded seal member 472 is held in the retracted position by a pin 474 preventing the movement of a spring 476 as best seen on the left side of FIG. 6. Once transition member 430 is joined to base pipes 436, 456, pin 474 is removed by any conventional means and spring 476 expands laterally moving a sleeve 478 of spring loaded seal member 472 into contact with outer shroud 442 and a sleeve 480 of spring loaded seal member 472 into contact with outer shroud 462 as best seen in the right side of FIG. 6. In accordance with the present invention, the sum of the cross sectional areas of slurry passageways 470 approximates the sum of the cross sectional areas of slurry passageways 444 or slurry passageways 464 thus the velocity of the fluid slurry within transition member 430 is maintained above the settling velocity of the fluid slurry.

Figure 7:
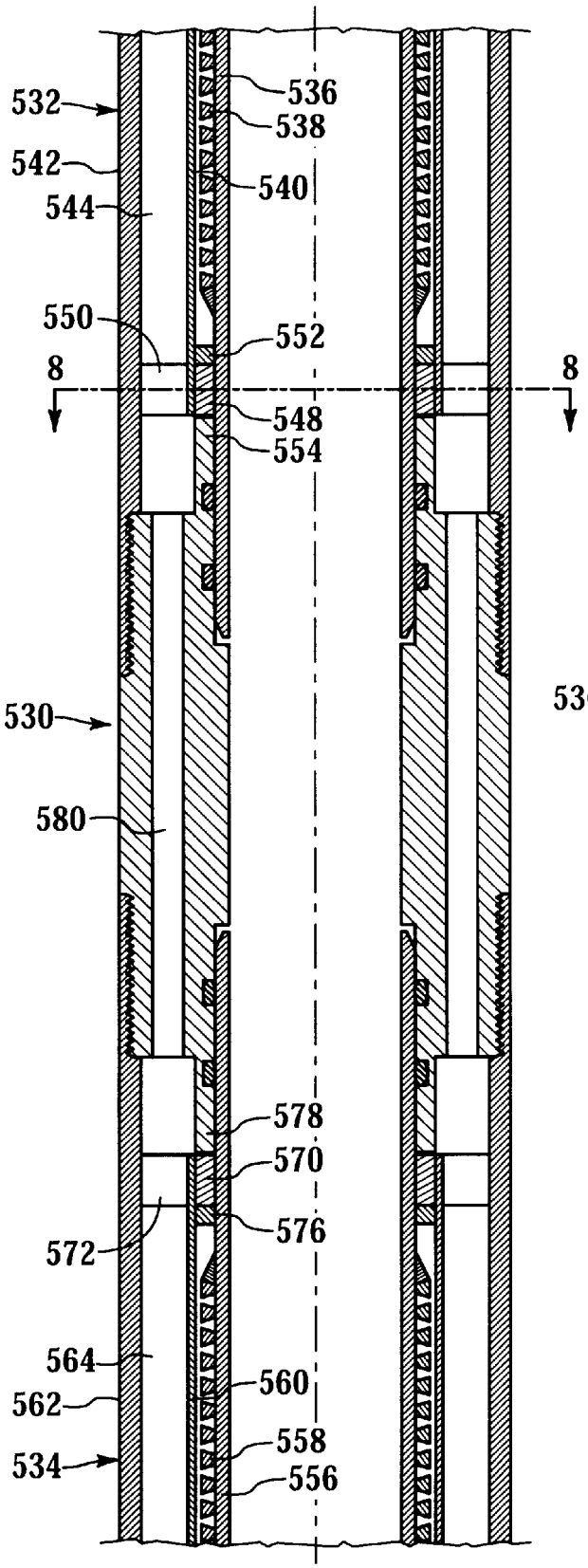
FIG. 7 is a half-sectional view of two sections of an apparatus for gravel packing an interval of a wellbore that are coupled together by a transition member of the present invention.
Figure 8:
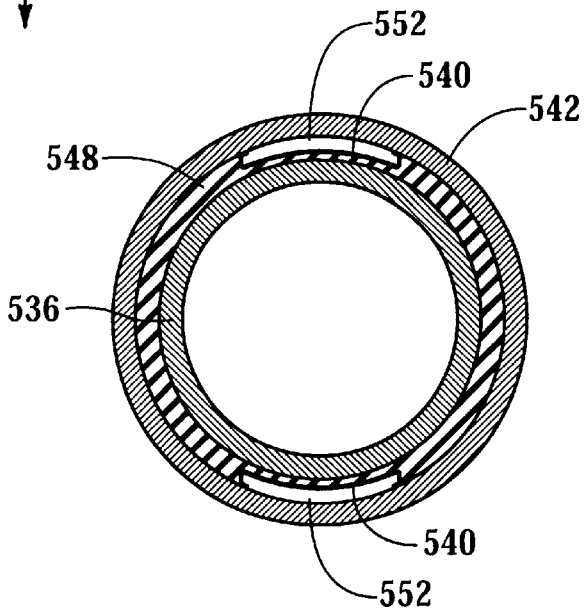
FIG. 8 is a cross sectional view of the apparatus for gravel packing an interval of a wellbore as viewed along line 8—8 of FIG. 7.

Referring now to FIGS. 7–8, in conjunction, a transition member of the present invention is illustrated and generally designated 530. Transition member 530 forms a fluid passageway between adjacent gravel packing apparatuses 532, 534 upon coupling apparatuses 532, 534 together. Apparatus 532 includes a base pipe 536 having a sand control screen 538 positioned therearound. Channels 540 are coupled to an outer shroud 542 forming slurry passageways 544 therebetween. A rubber element 548 is positioned between outer shroud 542 and base pipe 536 including openings 550 that receive the end portion of channels 540 such that the fluid slurry traveling through slurry passageways 544 may pass therethrough. Rubber element 548 can be energized between bearing 552 of base pipe 536 and shoulder 554 of transition 530.

Similarly, apparatus 534 includes a base pipe 556 having a sand control screen 558 positioned therearound. Channels 560 are coupled to an outer shroud 562 forming slurry passageways 564 therebetween. A rubber element 570 is positioned between outer shroud 562 and base pipe 556 to provide a seal. Openings 572 of rubber element 570 receives end portions of channels 560 such that the fluid slurry traveling through slurry passageways 564 may pass therethrough. Rubber element 570 may be energized between bearing 576 of base pipe 556 and shoulder 578 of transition 530.

Base pipes 536, 556 are slidably and sealably coupled to transition 530. In addition, outer shrouds 542, 562 are threadably coupled to transition 530. It may be preferable that transition 530 be coupled to apparatus 534 during fabrication such that only one connection is required at the rig floor.

In accordance with the present invention, transition member 530 provides a plurality of pathways 580 formed therethrough. The sum of the cross sectional areas of the plurality of pathways 580, preferably, approximates the sum of the cross sectional areas of the slurry passageways 544 or 564, thereby assuring that the velocity of the fluid slurry within transition member 530 is maintained above the settling velocity of the fluid slurry.

Figure 9:
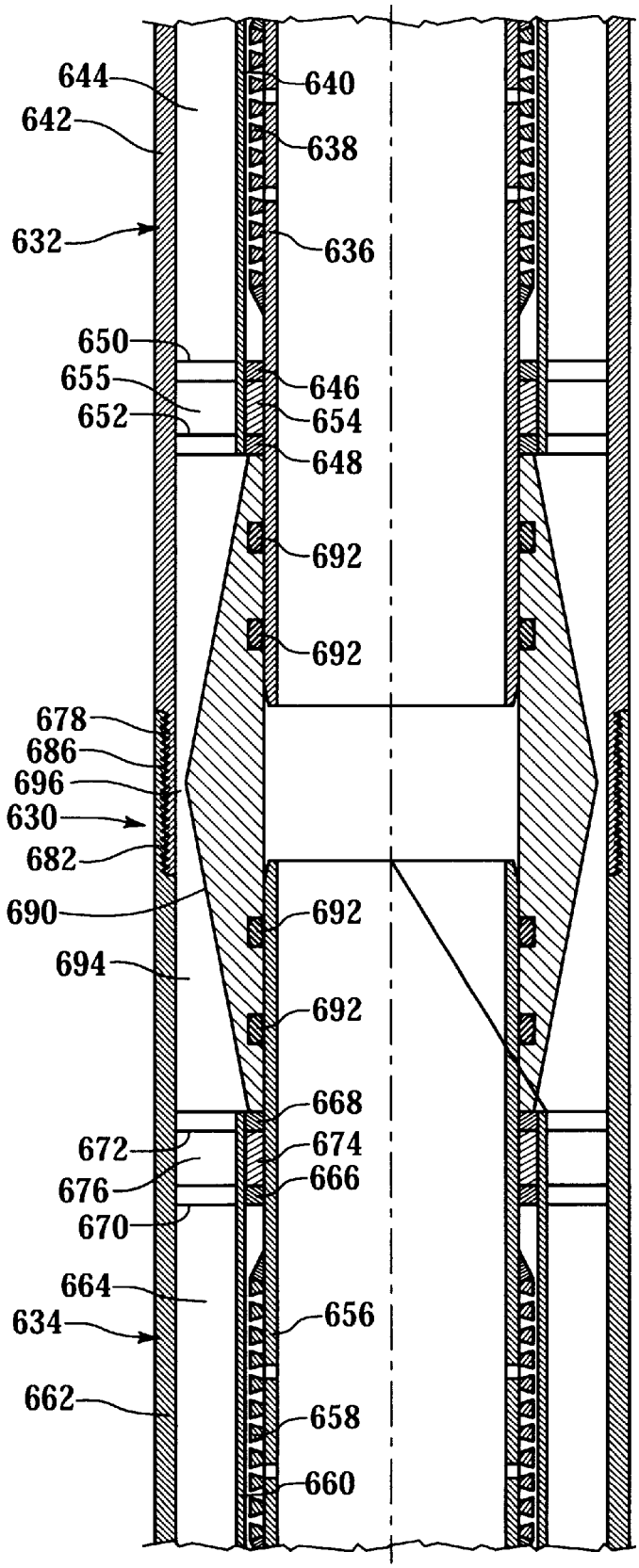
FIG. 9 is a quarter-sectional view of two sections of an apparatus for gravel packing an interval of a wellbore that are coupled together by a transition member of the present invention.

Referring now to FIG. 9, a transition member of the present invention which is illustrated and generally designated 630. Transition member 630 forms a fluid passageway between adjacent gravel packing apparatuses 632, 634 upon coupling apparatuses 632, 634 together. Apparatus 632 includes a base pipe 636 having a sand control screen 638 positioned therearound. Channels 640 are coupled to an outer shroud 642 and form a slurry passageway 644. A base plate 696 and a compression plate 648 are attached between base pipe 636 and outer shroud 642. Base plate 646 has openings 650 and compression plate 648 has openings 652 that are aligned with slurry passageways 644 such that the fluid slurry traveling through slurry passageways 644 may pass therethrough.

A rubber element 654 is positioned between outer shroud 642 and base pipe 636 to provide a seal therebewteen. Rubber element 654 includes openings 655 that are aligned with slurry passageways 644 such that the fluid slurry traveling through slurry passageways 644 may pass therethrough. Rubber element 654 is energized between base plate 646 and compression plate 648.

Similarly, apparatus 634 includes base pipe 656 having a sand control screen 658 positioned therearound. Channels 660 are coupled to an outer shroud 662 forming slurry passageways 664 therebetween. A base plate 666 and a compression plate 668 are attached between base pipe 656 and outer shroud 662. Base plate 666 has openings 670 and compression plate 668 has openings 672 such that the fluid slurry traveling through slurry passageways 664 may pass therethrough.

A rubber element 674 is positioned between outer shroud 662 and base pipe 656 to provide a seal therebewteen. Rubber element 674 includes openings 676 that are aligned with slurry passageways 664 such that the fluid slurry traveling through slurry passageways 664 may pass therethrough. Rubber element 674 is energized between base plate 666 and compression plate 668.

Outer shroud 642 includes a pin end 678 that threadably mates with a box end 682 of outer shroud 662 to form a threaded flush joint 686. Positioned with joint 686 is a sleeve 690 that couples base pipe 636 to base pipe 656. As the respective end sections of base pipes 636, 656 are slidably and sealably received within sleeve 690, this connection may be achieved at the rig floor. Alternatively, sleeve 690 could be attached to one of the ends of a base pipe during fabrication, in which case a threaded or welded attachment may be preferred for that connection. In the illustrated embodiment, a pair of seals 692 is positioned between sleeve 690 and each of the end sections of base pipes 636, 656.

In accordance with the present invention, transition member 630 provides an annular area 694 formed between coupling 690 and outer shrouds 642, 662. In the illustrated embodiment, the outer surface of coupling 690 has a contoured shape which approximates a pyramid creating an annular throat 696 which assures that the velocity of the fluid slurry within transition member 630 is maintained above the settling velocity of the fluid slurry. Notably, the distance between coupling 690 and outer shroud 642 near compression plate 648 and the distance between coupling 690 and outer shroud 662 near compression plate 668 is greater that the distance between coupling 690 and joint 686 near annular throat 696.

Figure 10:
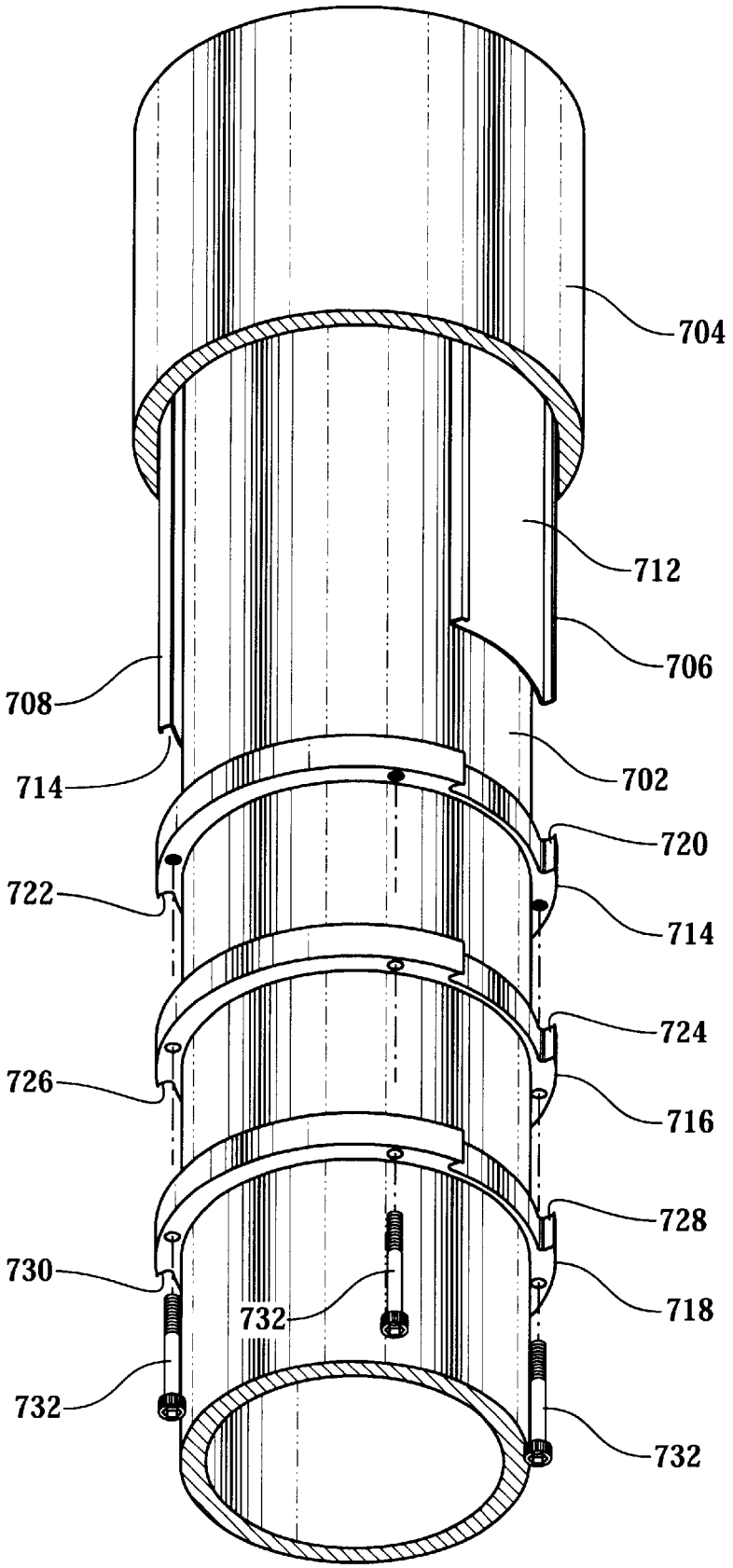
FIG. 10 is an exploded and partially cut-away perspective view of a seal member of the transition member of the present invention.

Referring now to FIG. 10, a sealing member of a transition 630 of FIG. 9 is illustrated and generally designated 700. Seal member 700 is sealingly positioned between a base pipe 702 and an outer shroud 704. Seal member 700 also supports and provides a seal around channels 706, 708, respectively. Seal member 700 includes a base plate 714, rubber element 716 and compression plate 718. Base plate 714 has openings 720, 722, rubber element 716 has openings 724, 726 and compression plate 718 has openings 728, 730. Openings 720, 724, 728 receive channel 706 such that the fluid slurry traveling through slurry passageway 712 may pass therethrough. Openings 722, 726, 730 receive channel 708, such that the fluid slurry traveling through slurry passageway 714 may pass therethrough. Additionally, base plate 714, rubber element 716 and compression plate 718 each have a plurality of holes operable to accept screws 732 or other fastening devices.

In operation, base plate 714 is preferably wielded to base pipe 702. It should be understood by those skilled in the art, however, that base plate 714 may alternatively be secured to base pipe 702 by other methods heretofore known or unknown in the art. In addition, base plate 714 could alternatively be secured to outer shroud 704 by welding, bolting or other suitable means. Rubber element 716 is positioned against base plate 714 such that openings 724, 726 are aligned with openings 720, 722, respectively. Compression plate 716, in turn, is positioned against rubber element 714 such that openings 728, 730 are aligned with openings 724, 726, respectively.

Screws 732 are then threadably coupled to base plate 714 through compression plate 718 and rubber element 716. As compression plate 718, rubber element 716 and base plate 714 are pulled together by screws 732, the lateral pressure compresses rubber element 716 and expands rubber element 716 radially. Accordingly, rubber element 716 provides a seal against base pipe 702, outer shroud 704 and channels 706, 708.

Figure 11:
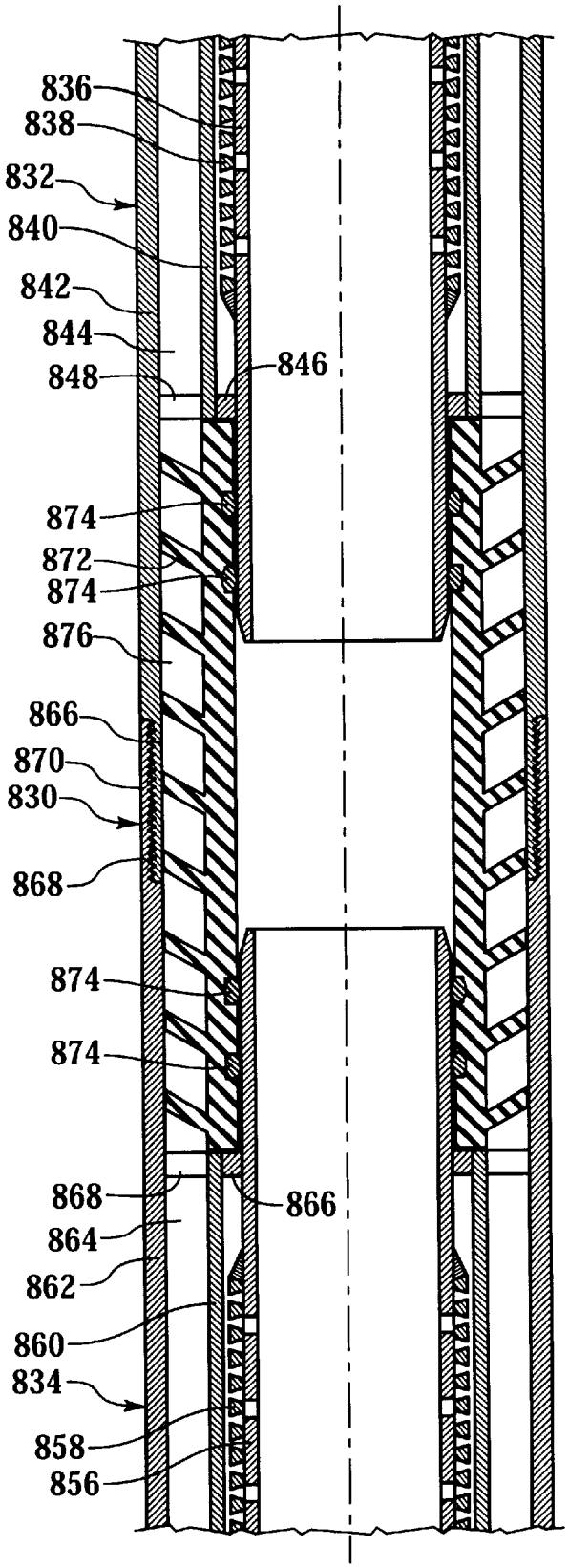
FIG. 11 is a half-sectional view of two sections of an apparatus for gravel packing an interval of a wellbore that are coupled together by a transition member of the present invention.
Figure 12:
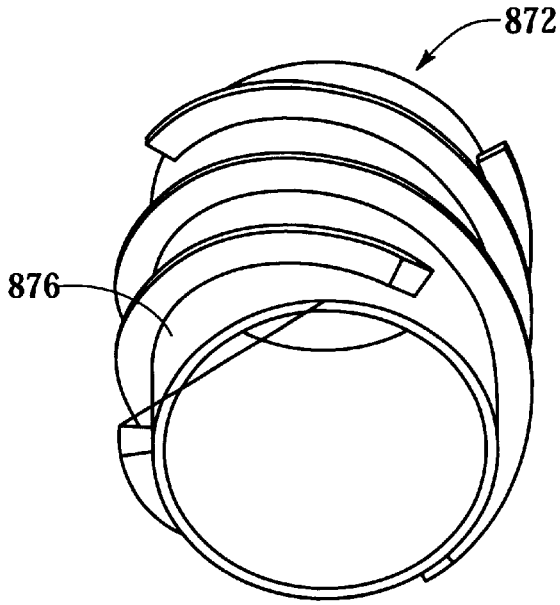
FIG. 12 is a partial cut-away perspective view of a portion of a transition member of the present invention.

Referring now to FIGS. 11–12, in conjunction, a transition member of the present invention is illustrated and generally designated 830. Transition member 830 forms a fluid passageway between adjacent gravel packing apparatuses 832, 834 upon coupling apparatuses 832, 834 together. Apparatus 832 includes a base pipe 836 having a sand control screen 838 positioned therearound. Channels 840 are coupled to an outer shroud 842 and form slurry passageways 844. A base plate 846 is attached between base pipe 834 and outer shroud 842. Base plate 846 has openings 848 that are aligned with slurry passageways 844 such that the fluid slurry traveling through slurry passageways 844 may pass therethrough.

Similarly, apparatus 834 includes base pipe 856 having a sand control screen 858 positioned therearound. Channels 860 are coupled to an outer shroud 862 forming slurry passageways 864 therebetween. A base plate 866 is attached between base pipe 856 and outer shroud 862. Base plate 866 has openings 868 that are aligned with slurry passageways 864 such that the fluid slurry traveling through slurry passageways 864 may pass therethrough.

Outer shroud 842 includes a pin end 866 that threadably mates with a box end 868 of outer shroud 862 having to form a threaded flush joint 870. Positioned with joint 870 is a coupling 872 that couples base pipe 836 to base pipe 856. As the respective end sections of base pipes 836, 856 are slidably and sealably received within coupling 872, this connection may be achieved at the rig floor. Alternatively, coupling 872 could be attached to one of the ends of a base pipe during fabrication, in which case a threaded or welded attachment may be preferred for that connection. In the illustrated embodiment, a pair of seals 874 is positioned between coupling 872 and each of the end sections of base pipes 836, 856.

In accordance with the present invention, transition member 830 provides a plurality of spiral fluid passageways 876 having an outer radial surface of the interior of outer shrouds 842, 862, as best seen in FIG. 12. The cross sectional area of fluid passageways 876, preferably, approximates the cross sectional area of slurry passageways 844, 864 thereby assuring that the velocity of the fluid slurry within transition member 830 is maintained above the settling velocity of the fluid slurry. It should be understood by one skilled in the art that although coupling 872 of the present invention is illustrated with a plurality of fluid passageways 876, coupling 872 could alternatively have a single fluid passageway.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A transition member for coupling first and second slurry delivery device and maintaining fluid slurry velocity therethrough comprising:

a first end operable to be coupled to the first slurry delivery device, the slurry delivery device having a first slurry passageway with a first cross sectional area;

a second end operable to be coupled to the second slurry delivery device, the second slurry delivery device having a second slurry passageway with a second cross sectional area that is approximately the same as the first cross sectional area; and an annular transition passageway operable to provide fluid communication between the first slurry passageway and the second slurry passageway, at least a portion of the transition passageway having a cross sectional area approximately the same as the first cross sectional area, thereby maintaining fluid slurry velocity when a fluid slurry travels therethrough.

2. The transition member as recited in claim 1 wherein the annular passageway further comprises an annular throat.

3. The transition member as recited in claim 2 wherein the annular throat is the position of the transition passageway having the cross sectional area approximately the same as the first cross sectional area.

4. The transition member as recited in claim 1 wherein portions of the annular passageway near the first and second slurry passageways have larger cross sectional areas than a portion of the annular passageway approximately half way between the first and second slurry passageways.

5. An apparatus for delivering a fluid slurry to a downhole location comprising:

a first slurry delivery device having a first slurry passageway with a first cross sectional area;

a second slurry delivery device having a second slurry passageway with a second cross sectional area that is approximately the same as the first cross sectional area; and a transition member having first and second ends and an annular transition passageway, the first and secured to the first slurry delivery device, the second end secured to the second slurry delivery device such that fluid communication is established between the first slurry passageway and second slurry passageway through the transition passageway, at least a portion of the transition passageway having a cross sectional area approximately the same as the first cross sectional area, thereby maintaining fluid slurry velocity when a fluid slurry travels therethrough.

6. The apparatus as recited in claim 5 wherein the annular passageway further comprises an annular throat.

7. The apparatus as recited in claim 6 wherein the annular throat is the portion of the transition passageway having the cross sectional area approximately the same as the first cross sectional area.

8. The apparatus as recited in claim 5 wherein portions of the annular passageway near the first and second slurry passageways have larger cross sectional areas than a portion of the annular passageway approximately half way between the first and second slurry passageways.

9. A transition member for coupling first and second slurry delivery devices each having a slurry passageway with first cross sectional area and maintaining fluid slurry velocity therethrough comprising:

an inner surface and an outer surface defining an annular passageway therebetween, at least one of the inner and the outer surfaces being a contoured surface such that the distance between the inner and the outer surfaces varies such that at least a portion of the transition passageway has a cross sectional area approximately the same as the first cross sectional area, thereby maintaining fluid slurry velocity when a fluid slurry travels therethrough.

10. The transition member as recited in claim 9 wherein the annular passageway further comprises an annular throat.

11. The transition member as recited in claim 9 wherein portions of the annular passageway near the first and second slurry delivery devices have larger cross sectional areas than a portion of the annular passageway approximately half way between the first and second slurry delivery devices.

12. The transition member as recited in claim 9 wherein the distance between the inner and outer surfaces of the annular passageway near the first and second slurry delivery devices is greater than the distance between the inner and outer surfaces of the annular passageway approximately half way between the first and second slurry delivery devices.

13. The transition member as recited in claim 9 wherein the contoured surface further comprises the inner surface.

14. The transition member as recited in claim 9 wherein the contoured surface further comprises an arc shaped surface.

15. The transition member as recited in claim 9 wherein the contoured surface further comprises a pyramid shaped surface.

16. The transition member as recited in claim 9 wherein the contoured surface further comprises a pyramid shaped surface with a plateau.

17. An apparatus for delivering a fluid slurry to a downhole location comprising:

a first slurry delivery device having a first slurry passageway with a first cross sectional area;

a second slurry delivery device having a second slurry passageway with a second cross sectional area that is approximately the same as the first cross sectional area; and a transition member having an inner surface and an outer surface defining an annular passageway therebetween providing fluid communication between the first slurry passageway and second slurry passageway, at least one of the inner and the outer surfaces being a contoured surface such that the distance between the inner and the outer surfaces varies and such that at least a portion of the transition passageway has a cross sectional area approximately the same as the first cross sectional area, thereby maintaining fluid slurry velocity when a fluid slurry travels therethrough.

18. The apparatus as recited in claim 17 wherein the annular passageway further comprises an annular throat.

19. The apparatus as recited in claim 17 wherein portions of the annular passageway near the first and second slurry delivery devices have larger cross sectional areas than a portion of the annular passageway approximately half way between the first and second slurry delivery devices.

20. The apparatus as recited in claim 17 wherein the distance between the inner and outer surfaces of the annular passageway near the first and second slurry delivery devices is greater than the distance between the inner and outer surfaces of the annular passageway approximately half way between the first and second slurry delivery devices.

21. The apparatus as recited in claim 17 wherein the contoured surface further comprises the inner surface.

22. The apparatus as recited in claim 17 wherein the contoured surface further comprises an arc shaped surface.

23. The apparatus as recited in claim 17 wherein the contoured surface further comprises a pyramid shaped surface.

24. The apparatus as recited in claim 17 wherein the contoured surface further comprises a pyramid shaped surface with a plateau.

25. A method for maintaining fluid slurry velocity between first and second slurry delivery devices comprising the steps of:

coupling a transition member between the first and second slurry delivery devices;

establishing fluid communication from a first slurry passageway of the first slurry delivery device to a second slurry passageway of the second slurry delivery device through an annular transition passageway of the transition member;

disposing the transition member and the first and second slurry delivery devices downhole;

pumping a fluid slurry into the first slurry passageway, through the transition member and into the second slurry passageway; and maintaining the fluid slurry velocity in the transition member by making the cross sectional area of at least a portion of the transition passageway approximately the same as the cross sectional area of the first slurry passageway.

26. The method as recited in claim 25 wherein the step of establishing fluid communication through the annular passageway further comprises establishing fluid communication through an annular throat.

27. The method as recited in claim 26 wherein the step of maintaining the fluid slurry velocity in the transition member further comprises making the cross sectional area of the annular throat approximately the same as the cross sectional area of the first slurry passageway.

28. The method as recited in claim 25 wherein the step of maintaining the fluid slurry velocity in the transition member further comprises making portions of the annular passageway near the first and second slurry passageways have larger cross sectional areas than a portion of the annular passageway approximately half way between the first and second slurry passageways.

29. A method for maintaining fluid slurry velocity between first and second slurry delivery devices comprising the steps of:

coupling a transition member between the first and second slurry delivery devices;

establishing fluid communication from a first slurry passageway of the first slurry delivery device to a second slurry passageway of the second slurry delivery device through an annular passageway of the transition member;

disposing the transition member and the first and second slurry delivery devices downhole;

pumping a fluid slurry into the first slurry passageway, through the transition member and into the second slurry passageway; and maintaining the fluid slurry velocity in the transition member by contouring at least one of the inner and the outer surfaces of the annular passageway such that the distance between the inner and the outer surfaces varies and such that at least a portion of the transition passageway has a cross sectional area approximately the same as a cross sectional area of the at least one first slurry passageway.

30. The method as recited in claim 29 wherein the step of maintaining the fluid slurry velocity in the transition member by contouring at least one of the inner and the outer surfaces of the annular passageway further comprises establishing an annular throat.

31. The method as recited in claim 29 wherein the step of maintaining the fluid slurry velocity in the transition member by contouring at least one of the inner and the outer surfaces of the annular passageway further comprises making portions of the annular passageway near the first and second slurry delivery devices have larger cross sectional areas than a portion of the annular passageway approximately half way between the first and second slurry delivery devices.

32. The method as recited in claim 29 wherein the step of maintaining the fluid slurry velocity in the transition member by contouring at least one of the inner and the outer surfaces of the annular passageway further comprises making the distance between the inner and outer surfaces of the annular passageway near the first and second slurry delivery devices greater than the distance between the inner and outer surfaces of the annular passageway approximately half way between the first and second slurry delivery devices.

33. The method as recited in claim 29 wherein the step of maintaining the fluid slurry velocity in the transition member by contouring at least one of the inner and the outer surfaces of the annular passageway further comprises making the contoured surface the inner surface.

34. The method as recited in claim 29 wherein the step of maintaining the fluid slurry velocity in the transition member by contouring at least one of the inner and the outer surfaces of the annular passageway further comprises making the contoured surface an arc shaped surface.

35. The method as recited in claim 29 wherein the step of maintaining the fluid slurry velocity in the transition member by contouring at least one of the inner and the outer surfaces of the annular passageway further comprises making the contoured surface a pyramid shaped surface.

36. The method as recited in claim 29 wherein the step of maintaining the fluid slurry velocity in the transition member by contouring at least one of the inner and the outer surfaces of the annular passageway further comprises making the contoured surface a pyramid shaped surface with a plateau.

* * * * *

UNITED STATES PATENT AND TRADEMARK OFFICE

CERTIFICATE OF CORRECTION

PATENT NO. : 6,715,545 B2
DATED : April 6, 2004
INVENTOR(S) : McGregor et al.

It is certified that error appears in the above-identified patent and that said Letters Patent is hereby corrected as shown below:

Title page,
Item [54], Title, "TRANSITION MEMBER FOR MAINTAINING FOR FLUID SLURRY VELOCITY THERETHROUGH AND METHOD FOR USE OF SAME" should read -- TRANSITION MEMBER FOR MAINTAINING FLUID SLURRY VELOCITY THERETHROUGH AND METHOD FOR USE OF SAME --.

Column 1,
Line 2, "FOR FLUID SLURRY VELOCITY" should read -- FLUID SLURRY VELOCITY --.

Column 14,
Line 41, "position" should read -- portion --.
Line 58, "and" should read -- end --.

Column 15,
Line 13, "with first" should read -- with a first --.

Column 17,
Line 15, "the at least one first" should read -- the first --.

Signed and Sealed this

Second Day of August, 2005

JON W. DUDAS
*Director of the United States Patent and Trademark Office*